US011840868B2

(12) United States Patent
Hayashi et al.

(10) Patent No.: US 11,840,868 B2
(45) Date of Patent: Dec. 12, 2023

(54) VEHICLE DOOR LOCK DEVICE

(71) Applicant: AISIN CORPORATION, Kariya (JP)

(72) Inventors: Takumi Hayashi, Kariya (JP); Yasuaki Tanino, Kariya (JP); Yasuhiko Sono, Kariya (JP)

(73) Assignee: AISIN CORPORATION, Aichi (JP)

( * ) Notice: Subject to any disclaimer, the term of this patent is extended or adjusted under 35 U.S.C. 154(b) by 513 days.

(21) Appl. No.: 17/038,755

(22) Filed: Sep. 30, 2020

(65) Prior Publication Data

US 2021/0102412 A1 Apr. 8, 2021

(30) Foreign Application Priority Data

Oct. 2, 2019 (JP) ..... 2019-182026

(51) Int. Cl.
*E05B 81/16* (2014.01)
*E05B 15/04* (2006.01)

(52) U.S. Cl.
CPC ..... *E05B 81/16* (2013.01); *E05B 15/04* (2013.01); *E05Y 2900/531* (2013.01)

(58) Field of Classification Search
CPC .. E05B 81/16; E05B 15/04; E05B 2015/0455; E05B 77/24; E05Y 2900/531
USPC ..... 292/336.3
See application file for complete search history.

(56) References Cited

U.S. PATENT DOCUMENTS

2013/0056996 A1* 3/2013 Akizuki ..... E05B 81/16 292/196
2015/0021934 A1* 1/2015 Barmscheidt ..... E05B 81/90 292/336.3
2018/0080262 A1* 3/2018 Takagi ..... E05B 85/02
2018/0080264 A1* 3/2018 Ichinose ..... E05B 81/76
2018/0355642 A1* 12/2018 Cumbo ..... E05B 83/36

FOREIGN PATENT DOCUMENTS

EP 1320652 B1 * 11/2005 ..... E05B 77/12
JP 2009013639 A * 1/2009 ..... E05B 81/06
JP 6213927 B2 9/2017

* cited by examiner

*Primary Examiner* — Kristina R Fulton
*Assistant Examiner* — James Edward Ignaczewski
(74) *Attorney, Agent, or Firm* — BUCHANAN INGERSOLL & ROONEY PC

(57) ABSTRACT

A vehicle door lock device includes: a latch mechanism switching member which switches a latch mechanism to an unlatching state; a first lever member which moves to an operating position when a door handle is operated to open a door; a link member movable to an unlock position where the link member is engaged with the latch mechanism switching member and the latch mechanism is switched to the unlatching state, and a lock position where the latch mechanism is not switched to the unlatching state; a second lever member releasably engageable with the link member and causing the latch mechanism switching member to move to the operating position by moving from an initial position to an operating position; a biasing member which biases the link member toward the lock position; and a drive unit which drives the second lever member to move from the initial position to the operating position.

6 Claims, 7 Drawing Sheets

VEHICLE DOOR LOCK DEVICE

CROSS REFERENCE TO RELATED APPLICATIONS

This application is based on and claims priority under 35 U.S.C. § 119 to Japanese Patent Application 2019-182026, filed on Oct. 10, 2019, the entire content of which is incorporated herein by reference.

TECHNICAL FIELD

This disclosure relates to a vehicle door lock device.

BACKGROUND DISCUSSION

A vehicle door lock device includes an electric drive unit for operating a lock mechanism with an electric drive force. A vehicle door lock device described in Japanese Patent No. 6213927 (Reference 1) includes a lock mechanism, a trigger lever configured to open a vehicle door by operating this lock mechanism, an electric drive unit which drives this trigger lever, and a lock lever which can move to a lock position and an unlock position. In the vehicle door lock device described in Reference 1, the lock lever is held at the lock position when the electric drive unit drives the trigger lever to operate the lock mechanism (to open the vehicle door) in a normal operation.

In a configuration described in Reference 1, a biasing member such as a spring which biases the lock lever toward the lock position is necessary so that the lock lever is held at the lock position when the electric drive unit drives the trigger lever. Further, in order to return the trigger lever to an initial position after an operation of the lock mechanism is completed, a biasing member such as a spring which biases the trigger lever toward the initial position is necessary. In this way, in a configuration in which the lock lever is held in the lock position during the operation of the trigger lever, the biasing member which returns the trigger lever to the initial position and the biasing member which holds the lock lever at the lock position are separately necessary, which increases the number of components. Further, a space for disposing the biasing members is necessary, which causes an increase in a size of the door lock device.

A need thus exists for a vehicle door lock device which is not susceptible to the drawback mentioned above.

SUMMARY

In order to solve the above problems, a vehicle door lock device according to this disclosure includes: a latch mechanism switching member (36) configured to switch a latch mechanism to an unlatching state by moving from an initial position to an operating position, the latch mechanism being switchable to a latching state in which a vehicle door (1) is held in a closed state and an unlatching state in which the closed state of the vehicle door (1) is released; a first lever member (34) configured to move to an operating position when a door handle (16 and 17) provided on the vehicle door (1) is operated to open the door; a link member (35) which is movable to an unlock position where the link member is engaged with the latch mechanism switching member (36) and the latch mechanism is switched to the unlatching state when the first lever member (34) moves to the operating position, and a lock position where the link member is not engaged with the latch mechanism switching member (36) and the latch mechanism is not switched to the unlatching state; a second lever member (38) which is releasably engageable with the link member (35) and is configured to cause the latch mechanism switching member (36) to move to the operating position by moving from an initial position to an operating position; a biasing member (50) configured to bias the link member toward the lock position; and a drive unit (39 and 40) configured to drive the second lever member (38) to move from the initial position to the operating position. When the second lever member (38) is driven by the drive unit (39 and 40) to move to the operating position, the second lever member (38) causes the latch mechanism switching member (36) to move to the operating position, and causes the link member (35) to move to the unlock position against a biasing force of the biasing member (50). When the drive unit (39 and 40) stops after moving the second lever member (38) to the operating position, the link member (35) moves to the lock position by the biasing force of the biasing member (50) and causes the second lever member (38) to move to the initial position.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
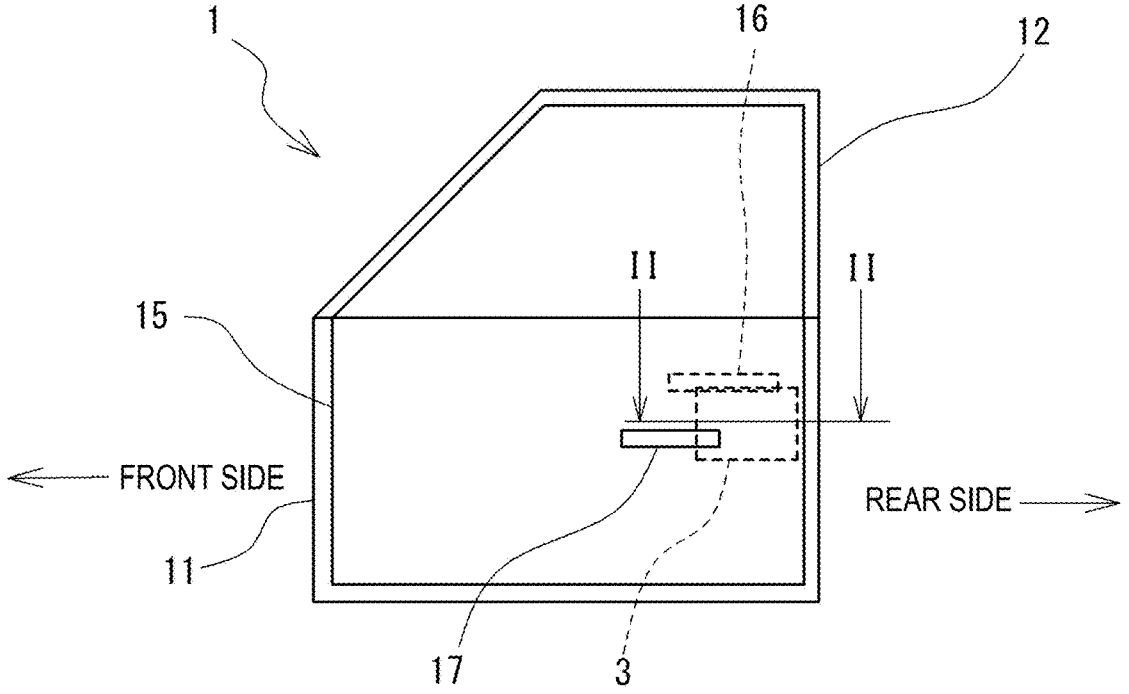
FIG. 1 is a schematic view illustrating a configuration example of a vehicle door to which a vehicle door lock device according to an embodiment disclosed here is applied.
Figure 2:
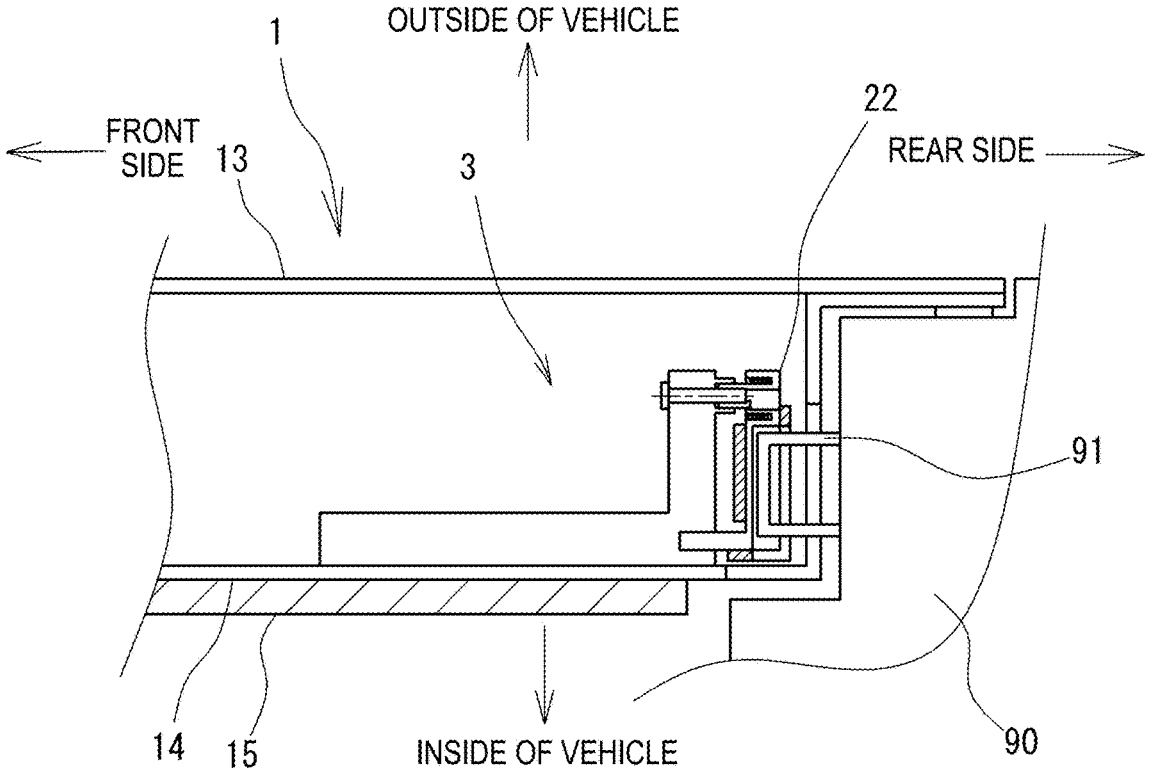
FIG. 2 is a cross-sectional view taken along a line II-II of FIG. 1.

Hereinafter, a vehicle door lock device according to an embodiment disclosed here will be described with reference to the drawings. For convenience of description, the vehicle door lock device according to the embodiment disclosed here may be simply referred to as a "door lock device". FIGS. 1 and 2 are schematic views illustrating a configuration example of a vehicle door 1 to which a door lock device 3 is applied. FIG. 1 is a side view of the vehicle door 1 as viewed from an inside of a vehicle. FIG. 2 is a cross-sectional view in the vicinity of a rear end portion of the vehicle door 1 and is a cross-sectional view taken along a line II-II of FIG. 1.

The vehicle door 1 includes a door main body 11 constituting a lower half of the vehicle door 1 and a door sash 12 provided in an upper half of the vehicle door 1. The door main body 11 includes an outer panel 13 which constitutes an outer surface, an inner panel 14 which is fixed to an inner surface of the outer panel 13, and a resin trim 15 which is fixed to the inner surface of the inner panel 14 and constitutes an inner surface of the door main body 11. An outside door handle 16 and an inside door handle 17 are respectively attached to the outer panel 13 and the trim 15 in a rotatable manner with respect to the vehicle door 1. The outside door handle 16 and the inside door handle 17 are examples of a door handle disclosed here.

As illustrated in FIG. 2, the door lock device 3 is disposed inside the vehicle door 1 (in an internal space between the outer panel 13 and the inner panel 14). A part of the door lock device 3 is exposed to an outside at the rear end portion of the vehicle door 1. The door lock device 3 is fixed to the inner panel 14 (that is, the vehicle door 1).

The door lock device 3 includes a latch mechanism which is switchable between a latching state and an unlatching state. The latching state means a state in which the vehicle door 1 can be held in a closed state, and the unlatching state means a state in which the closed state of the vehicle door 1 can be released. Further, the door lock device 3 is switchable between a locked state and an unlocked state. The locked state means a state in which the latch mechanism cannot be switched to the unlatching state by door opening operations of the inside door handle 17 and the outside door handle 16 (a state in which the closed state of the vehicle door 1 cannot be released). The unlocked state means a state in which the latch mechanism can be switched to the unlatching state by the door opening operations of the inside door handle 17 and the outside door handle 16. The latch mechanism is switchable between the latching state and the unlatching state by the door opening operations (manual operations) of the inside door handle 17 and the outside door handle 16, and the door lock device 3 is switchable between the locked state and the unlocked state by a driving force of an actuator 40.

Figure 3:
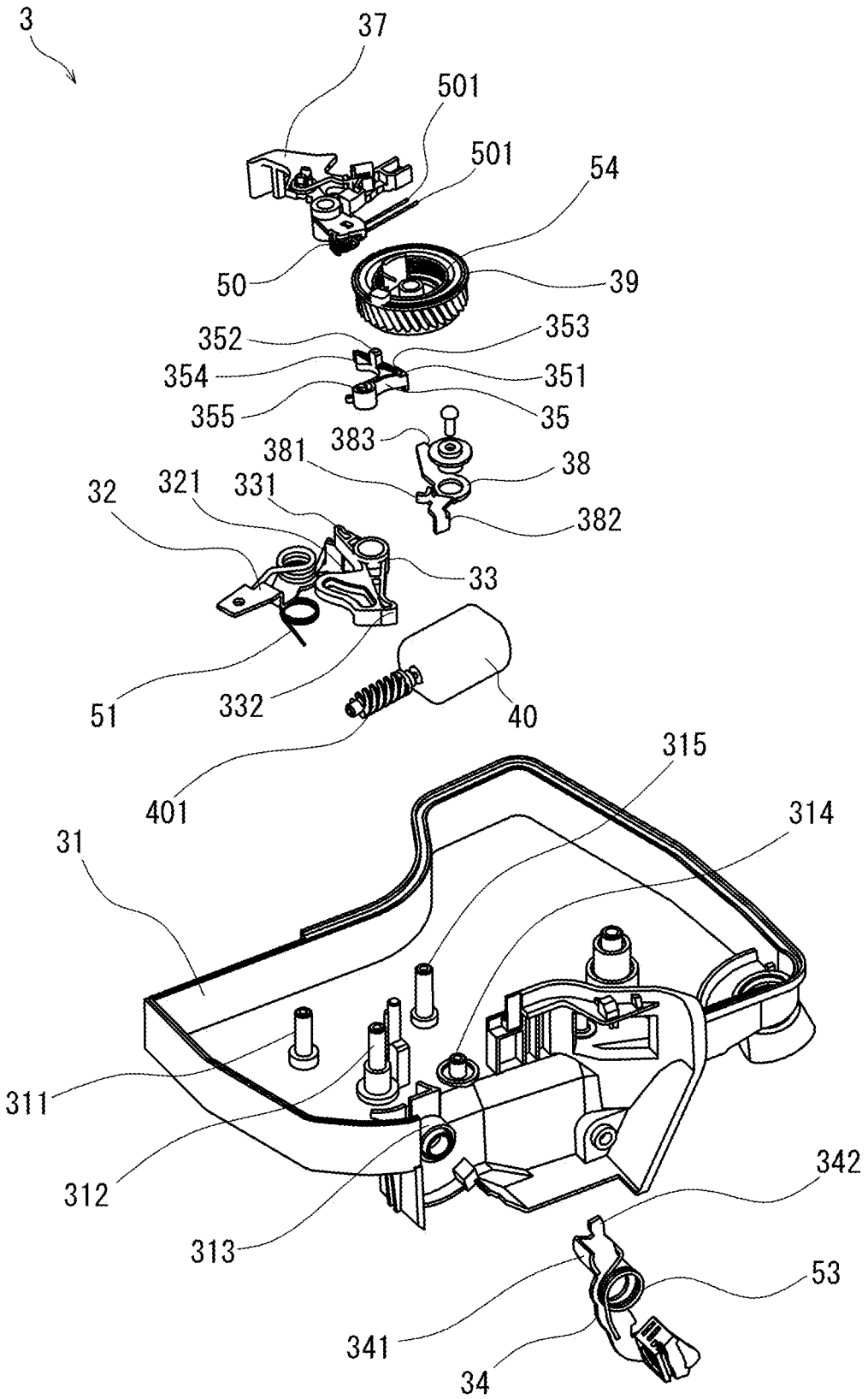
FIG. 3 is an exploded perspective view illustrating a configuration example of the vehicle door lock device according to the embodiment disclosed here.

FIG. 3 is an exploded perspective view illustrating a configuration example of the door lock device 3. As illustrated in FIG. 3, the door lock device 3 includes a housing 31, an inside open lever 32, an inside lever 33, an outside open lever 34 which is an example of a first lever member disclosed here, an open link 35 which is an example of a link member disclosed here, a lift lever 36 which is an example of a latch mechanism switching member disclosed here, an active lever 37 which is an example of a third lever member disclosed here, a release lever 38 which is an example of a second lever member disclosed here, a rotation member 39, the actuator 40, and the latch mechanism (not illustrated). The lift lever 36 may be included in the latch mechanism.

The housing 31 is a member having a function of housing the door lock device 3. The housing includes a first support portion 311, a second support portion 312, a third support portion 313, a fourth support portion 314, and a fifth support portion 315. The first support portion 311 rotatably supports the inside open lever 32. The second support portion 312 rotatably supports the inside lever 33 and the active lever 37. The third support portion 313 rotatably supports the outside open lever 34. The fourth support portion 314 rotatably supports the release lever 38. The fifth support portion 315 rotatably supports the rotation member 39. Configurations of the first support portion 311 to the fifth support portion 315 are not particularly limited, and as illustrated in FIG. 3, a columnar or cylindrical shaft can be applied. Further, a shaft hole is formed in each of the inside open lever 32, the inside lever 33, the outside open lever 34, the active lever 37, the release lever 38, and the rotation member 39. By inserting the support portions 311 to 315 into respective shaft holes of these members, these members are rotatably supported about the respective support portions 311 to 315.

The inside open lever 32, the inside lever 33, the outside open lever 34, the lift lever 36, the active lever 37, the release lever 38, and the rotation member 39 are rotatably supported on the housing 31. Rotation center lines of the inside open lever 32, the inside lever 33, the active lever 37, the release lever 38, and the rotation member 39 are parallel to each other. A rotation center line of the outside open lever 34 is perpendicular to the rotation center lines of the inside open lever 32, the inside lever 33, the active lever 37, the release lever 38, and the rotation member 39. The open link 35 is rotatably supported with respect to the outside open lever 34. The actuator 40 is a driving force source that rotationally drives the rotation member 39, and is fixed to the housing 31.

Figure 4:
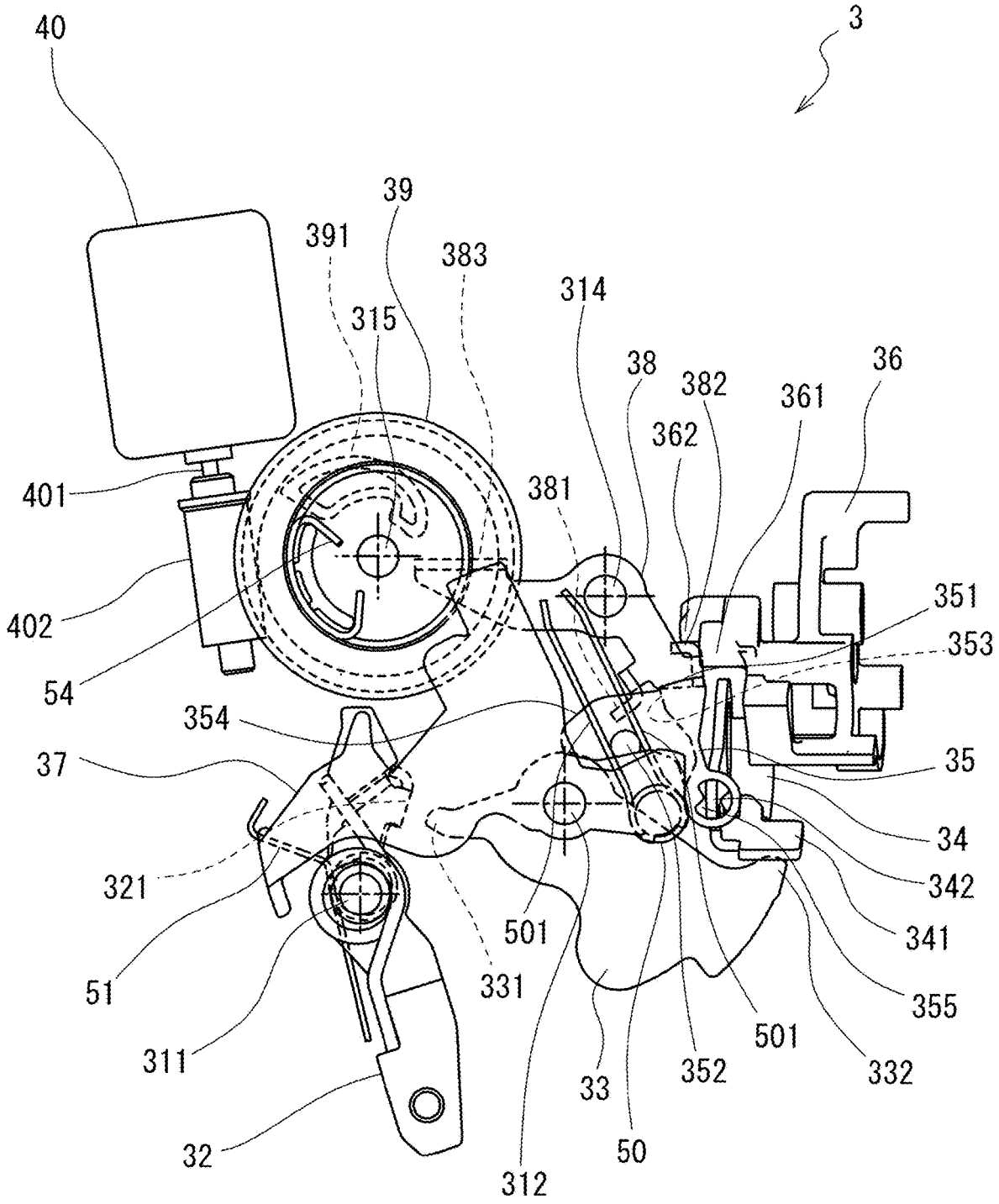
FIG. 4 illustrates the configuration example and an operation of the vehicle door lock device according to the embodiment disclosed here, and illustrates a locked state.
Figure 5:
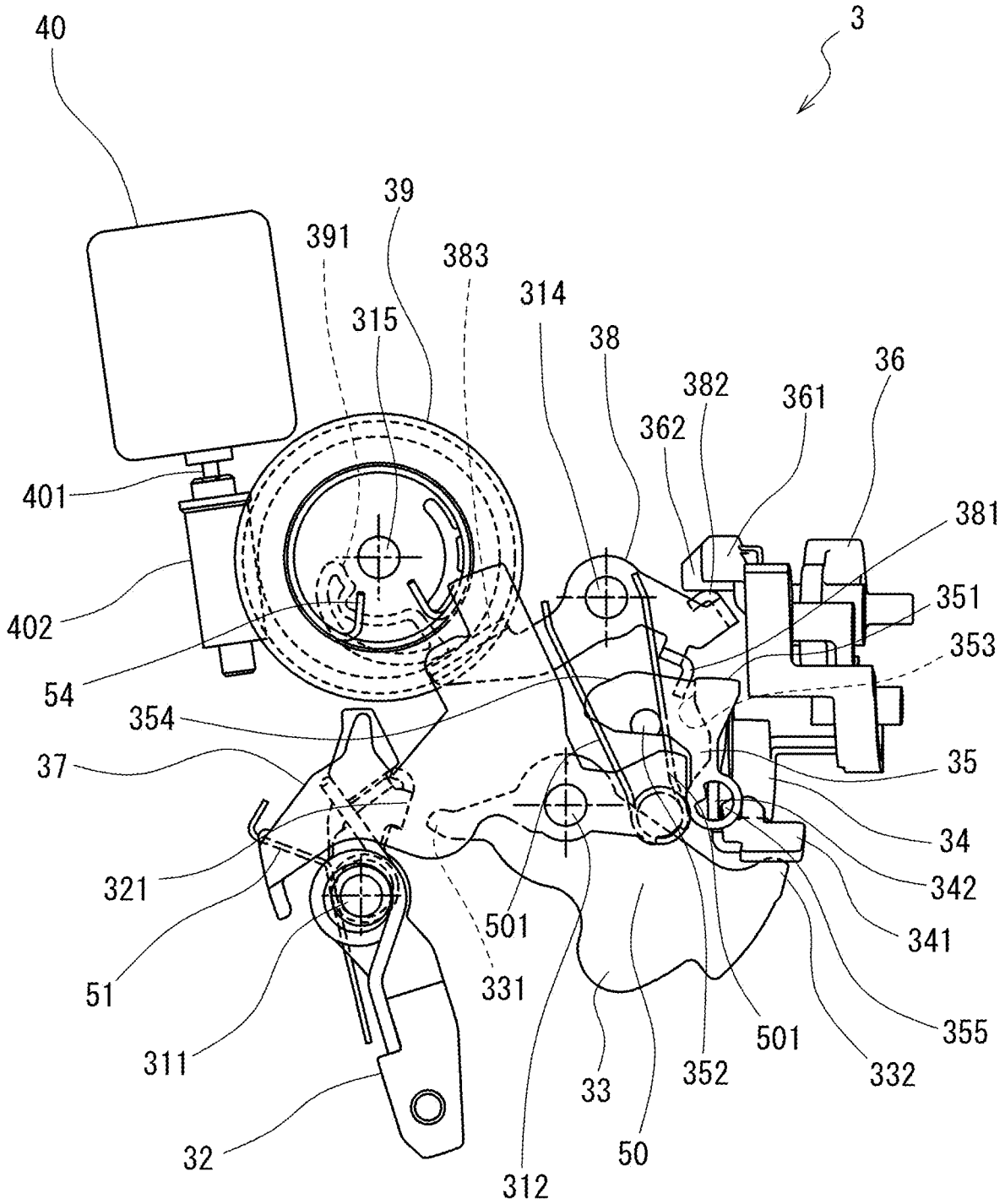
FIG. 5 illustrates the configuration example and the operation of the vehicle door lock device according to the embodiment disclosed here, and illustrates a released state.
Figure 6:
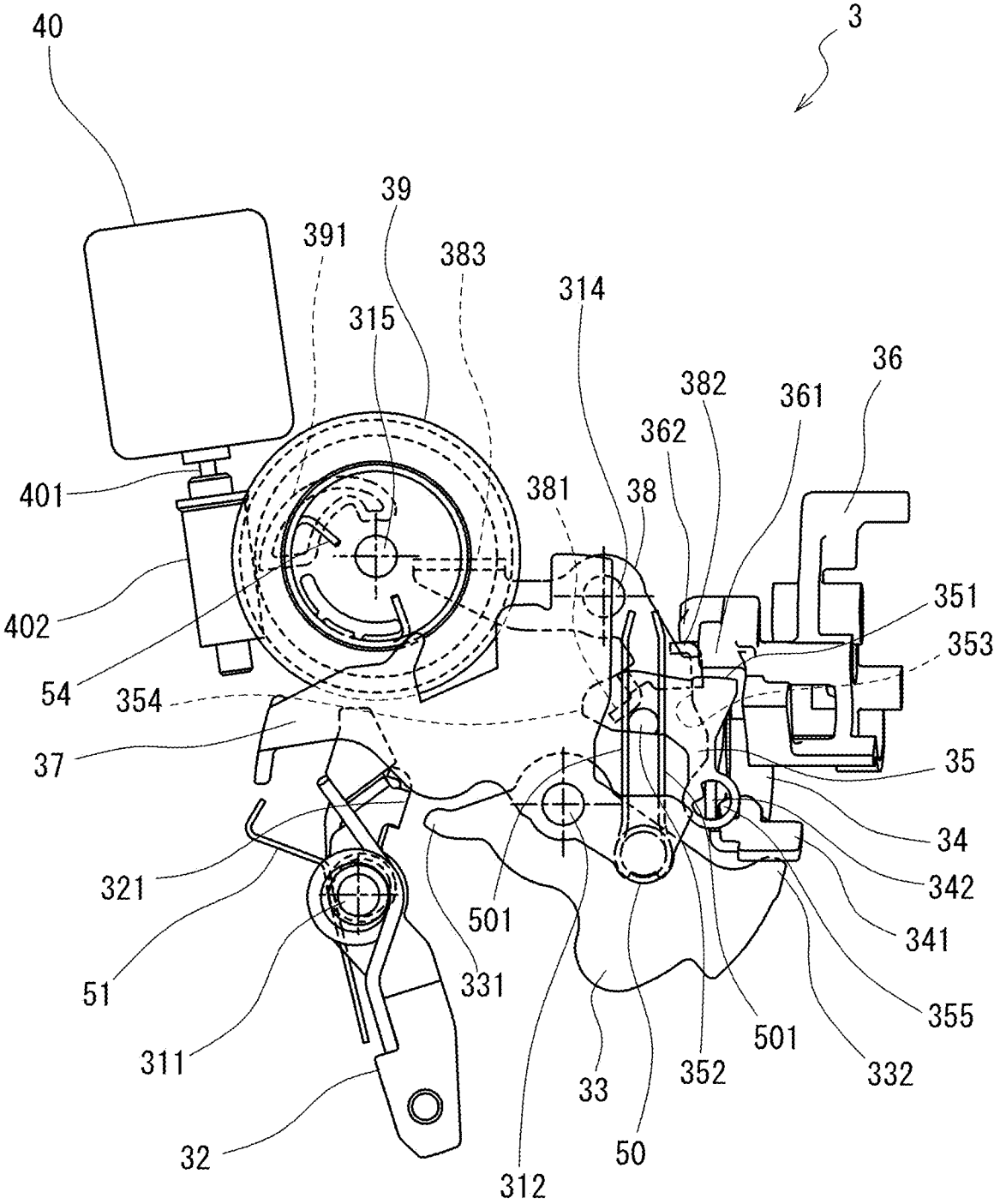
FIG. 6 illustrates the configuration example and the operation of the vehicle door lock device according to the embodiment disclosed here, and illustrates an unlocked state.
Figure 7:
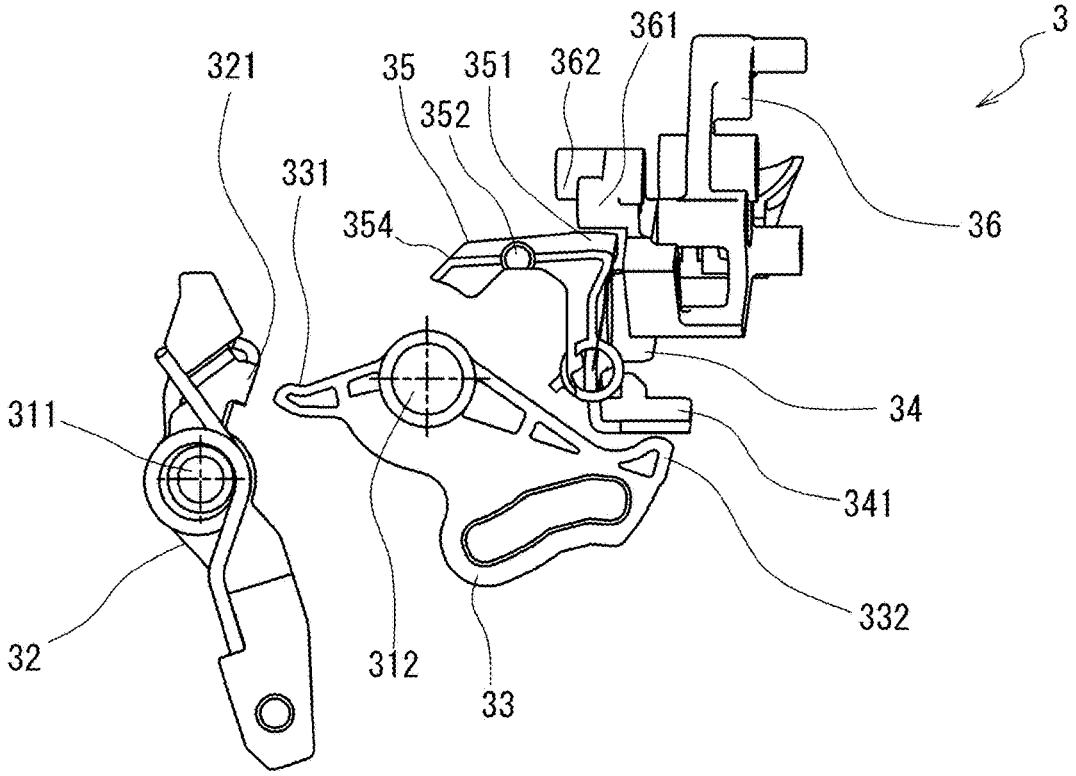
FIG. 7 illustrates the configuration example and the operation of the vehicle door lock device according to the embodiment disclosed here, and illustrates an operation at a time of manual operation.
Figure 8:
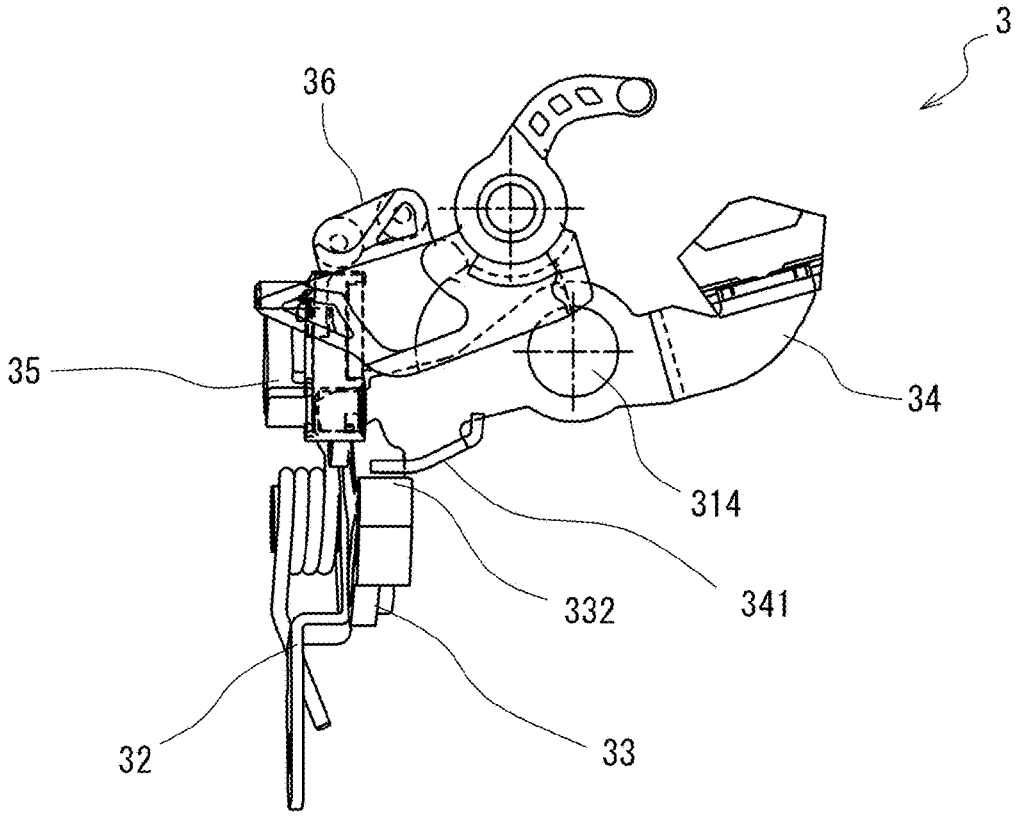
FIG. 8 illustrates the configuration example and the operation of the vehicle door lock device according to the embodiment disclosed here, and illustrates an operation at the time of manual operation.
Figure 9:
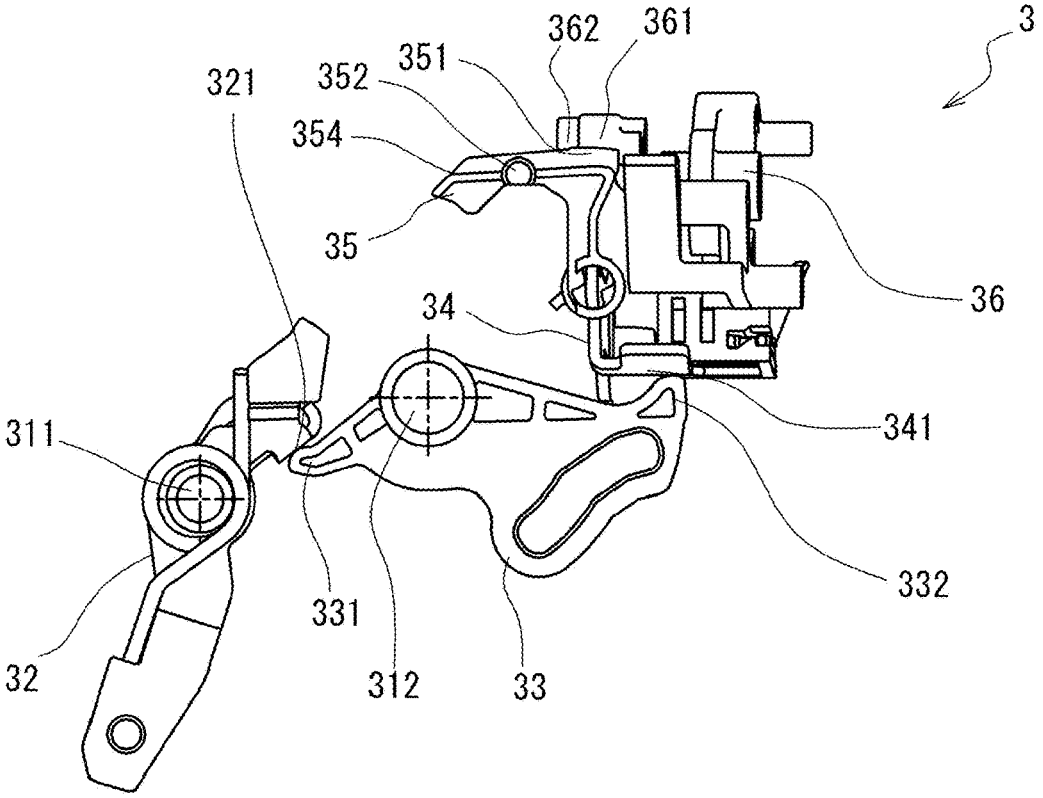
FIG. 9 illustrates the configuration example and the operation of the vehicle door lock device according to the embodiment disclosed here, and illustrates an operation at the time of manual operation.
Figure 10:
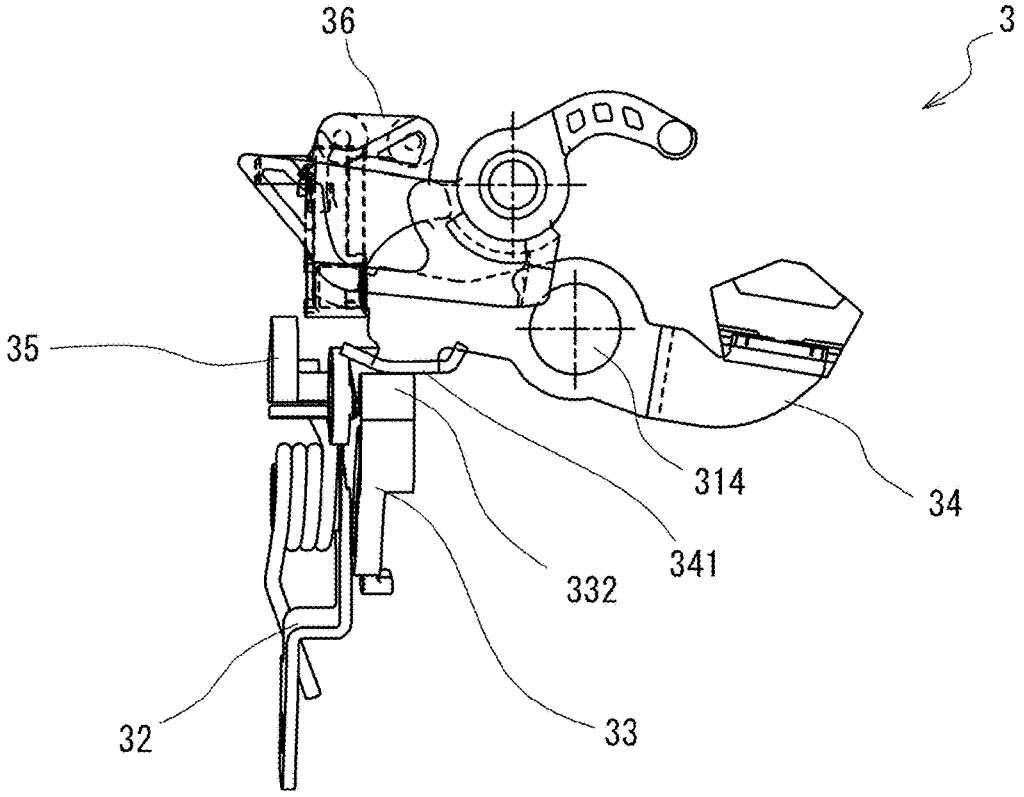
FIG. 10 illustrates the configuration example and the operation of the vehicle door lock device according to the embodiment disclosed here, and illustrates an operation at the time of manual operation.

FIGS. 4 to 10 are views illustrating a configuration and operations of the door lock device 3. FIGS. 4 to 6 illustrate an operation by the driving force of the actuator 40, and FIGS. 7 to 10 illustrate an operation by the manual operation. FIG. 4 illustrates the locked state of the door lock device 3, FIG. 5 illustrates the operation of bringing the latch mechanism into the unlatching state when the door lock device 3 is in the locked state, and FIG. 6 illustrates the unlocked state. In FIGS. 4 to 6, a part of lines is omitted for easy understanding of positional relationships of members. FIGS. 7 to 10 illustrate the operation of bringing the latch mechanism into the unlatching state when the door lock device 3 is in the unlocked state. Specifically, FIGS. 7 and 8 illustrate a state in which neither the outside door handle 16 nor the inside door handle 17 is operated to open the door, and FIGS. 9 and 10 illustrate a state in which the inside door handle 17 is operated to open the door. Further, FIG. 8 is a view of FIG. 7 viewed from a direction different therefrom by 90°, and FIG. 10 is a view of FIG. 9 viewed from a direction different therefrom by 90°.

The inside open lever 32 is rotatably supported on the housing 31 by the first support portion 311, and can move to an initial position and an operating position by rotating. FIGS. 4 to 8 illustrate a state in which the inside open lever 32 is located at the initial position, and FIGS. 9 and 10 illustrate a state in which the inside open lever 32 is located at the operating position. In FIGS. 4 to 7, the operating position of the inside open lever 32 is a position where the inside open lever 32 rotates from the initial position in a clockwise direction by a predetermined angle.

The inside open lever 32 is linked to the inside door handle 17 provided on the vehicle door 1, and can move from the initial position to the operating position in conjunction with the door opening operation (an operation of rotating the inside door handle 17 with respect to the vehicle door 1) of the inside door handle 17. For example, the inside open lever 32 and the inside door handle 17 are coupled with an operation wire (not illustrated). Further, the inside open lever 32 is constantly biased toward the initial position by an inside open lever return spring 51. When the inside door handle 17 is not operated to open the door, the inside open lever 32 is held at the initial position by a biasing force of the inside open lever return spring 51.

The inside open lever 32 includes an engaging portion 321 which is releasably engageable with a first engaging portion 331 of the inside lever 33. Further, when the inside open lever 32 moves from the initial position to the operating position, the engaging portion 321 of the inside open lever 32 is engaged with the first engaging portion 331 of the inside lever 33 to push the first engaging portion 331, and causes the inside lever 33 to move from an initial position to an operating position.

The inside lever 33 is rotatably supported on the housing 31 by the second support portion 312, and can move to the initial position and the operating position by rotating. FIGS. 4 to 6 illustrate a state in which the inside lever 33 is located at the initial position. In FIGS. 4 to 6, the operating position of the inside lever 33 is a position where the inside lever 33 rotates from the initial position in a counterclockwise direction by a predetermined angle (see FIG. 8).

The inside lever 33 includes the first engaging portion 331 which is releasably engageable with the engaging portion 321 of the inside open lever 32, and a second engaging portion 332 which is releasably engageable with an engaging portion 341 of the outside open lever 34. Further, when the inside lever 33 rotationally moves from the initial position to the operating position according to the rotation movement of the inside open lever 32, the second engaging portion 332 is engaged with the engaging portion 341 of the outside open lever 34 to push the engaging portion 341, and causes the outside open lever 34 to rotationally move from an initial position to an operating position.

The outside open lever 34 is the example of the first lever member disclosed here. The outside open lever 34 is rotatably supported on the housing 31 by the third support portion 313, and can move to the initial position and the operating position by rotating. FIGS. 4 to 8 illustrate a state in which the outside open lever 34 is located at the initial position, and FIGS. 9 and 10 illustrate a state in which the outside open lever 34 is located at the operating position. The rotation center line of the outside open lever 34 is in a direction parallel to left and right ends in FIGS. 4 to 7 and 9, and is in a direction perpendicular to a paper surface in FIGS. 8 and 10.

The outside open lever 34 is linked to the outside door handle 16. For example, the outside open lever 34 is coupled to the outside door handle 16 with an operation wire. The outside open lever 34 rotationally moves from the initial position to the operating position in conjunction with the door opening operation (an operation of rotating the outside door handle 16 with respect to the vehicle door 1) of the outside door handle 16. Further, the outside open lever 34 includes the engaging portion 341, and rotationally moves from the initial position to the operating position by the engaging portion 341 being engaged with and pressed by the second engaging portion 332 of the inside lever 33.

The outside open lever 34 is constantly biased toward the initial position by an outside open lever return spring 53 (see FIG. 3). When the outside door handle 16 is not operated to open the door and the inside lever 33 is not located at the operating position (that is, when the inside door handle 17 is not operated to open the door), the outside open lever 34 is held at the initial position by a biasing force of the outside open lever return spring 53.

The open link 35 is the example of the link member disclosed here. The open link 35 is rotatably supported with respect to the outside open lever 34. For example, the outside open lever 34 includes a support portion 342, and the open link 35 has an opening 355. By inserting the support portion 342 of the outside open lever 34 into the opening 355 of the open link 35, the open link 35 is rotatably supported with respect to the outside open lever 34. Further, the open link 35 can move to an initial position and an operating position by rotating with respect to the housing 31 together with the outside open lever 34.

The open link 35 includes a first engaging portion 351 which is releasably engageable with a first engaging portion 361 of the lift lever 36. The open link 35 can move to an unlock position and a lock position by relatively rotating with respect to the outside open lever 34. The unlock position is a position where, when the open link 35 moves from the initial position to the operating position together with the outside open lever 34, the first engaging portion 351 of the open link 35 is engaged with the first engaging portion 361 of the lift lever 36 to cause the lift lever 36 to move to an operating position. That is, the unlock position is a state in which the closed state of the vehicle door 1 can be released. The lock position is a position (a position where the open link 35 does not cause the lift lever 36 to move to the operating position) where, even when the open link 35 moves from the initial position to the operating position, the first engaging portion 351 of the open link 35 is not engaged with the first engaging portion 361 of the lift lever 36. That is, the lock position is a state in which the closed state of the vehicle door 1 cannot be released by the door opening operations of the outside door handle 16 and the inside door handle 17. FIG. 4 illustrates the state in which the open link 35 is located at the lock position, and FIGS. 5 and 6 illustrate the state in which the open link 35 is located at the unlock position.

The open link 35 includes a second engaging portion 352 which is engaged with a biasing member 50. The second engaging portion 352 can be applied as a protrusion-shaped configuration which protrudes from a rod-shaped portion 354 extending from the first engaging portion 351 in a rotation center line (axis) direction of the open link 35. The open link 35 is linked to the active lever 37 via the biasing member 50. Further, the open link 35 includes a third engaging portion 353 which is releasably engageable with a first engaging portion 381 of the release lever 38 to be described later.

The biasing member 50 has a function of biasing the open link 35 toward either the lock position or the unlock position according to a position of the active lever 37. Further, the biasing member 50 also has a function of biasing the release lever 38 toward an initial position.

In the present embodiment, the biasing member 50 is a torsion coil spring including two arms 501. These two arms 501 protrudes substantially parallel and in substantially the same direction. The biasing member 50 is elastically deformable so that an interval between the two arms 501 increases. The biasing member 50 is attached to the active lever 37 and rotates integrally with the active lever 37 with respect to the housing 31. Further, the second engaging portion 352 of the open link 35 is disposed between the two arms 501. In this way, the active lever 37 and the open link 35 are linked via the biasing member 50 attached to the active lever 37.

The active lever 37 is the example of the third lever member disclosed here. The active lever 37 is rotatably supported by the second support portion 312 with respect to the housing 31, and can move to a first position and a second position by rotating. FIGS. 4 and 5 illustrate a state in which the active lever 37 is located at the first position, and FIG. 6 illustrates a state in which the active lever 37 is located at the second position. The present embodiment illustrates an example in which the active lever 37 and the inside lever 33 are coaxially and rotatably supported by the second support portion 312.

The active lever 37 is linked to a key cylinder provided in the vehicle door 1. For example, the active lever 37 is coupled to each part of the key cylinder via a predetermined member. The active lever 37 can move to the first position and the second position according to an operation of the key cylinder. Further, the active lever 37 can also move to the first position and the second position by rotation of the rotation member 39.

As illustrated in FIG. 4, when the active lever 37 is located at the first position, and the release lever 38 to be described later is located at the initial position, the open link 35 is held in the lock position by the biasing member 50. Further, as illustrated in FIG. 5, when the active lever 37 is located at the first position, one of the two arms 501 of the biasing member 50 is pushed by the second engaging portion 352 of the open link 35 and the biasing member 50 is elastically deformed so that the interval between the two arms 501 increases, which allows the open link 35 to move from the lock position to the unlock position. In this case, the open link 35 is biased toward the lock position by the biasing member 50. Specifically, when the second engaging portion 352 of the open link 35 is pushed by one of the two arms 501 of the biasing member 50, the open link 35 is biased toward the lock position.

The lift lever 36 is the example of the latch mechanism switching member disclosed here. The lift lever 36 is rotatably supported with respect to the housing 31, and can move to an initial position and an operating position by rotating. The lift lever 36 switches the latch mechanism from the latching state to the unlatching state when moving from the initial position to the operating position. In the present embodiment, the lift lever 36 is rotatably supported on a frame (not illustrated), and by rotating with respect to this frame, the lift lever 36 also rotates with respect to the housing 31.

The latch mechanism (not illustrated) is switchable between the latching state in which the vehicle door 1 can be held in the closed state and the unlatching state in which the closed state of the vehicle door 1 can be released. A specific configuration of the latch mechanism is not particularly limited, and various known configurations can be applied. For example, the following configurations can be applied.

The latch mechanism includes a latch and a pole. The latch is rotatably supported on the frame of the door lock device 3, and can rotationally move to an unlatch position, a half latch position, and a full latch position. The unlatch position is a position (releasable position) where a striker 91 provided on a vehicle body 90 is not held. The half latch position and the full latch position are positions where the striker 91 is held when the vehicle door 1 is in the closed state. Further, the latch is constantly biased toward the unlatch position by a latch return spring.

The pole is rotatably supported on the frame of the door lock device 3 and can move to an engagement position and a non-engagement position. The engagement position is a position where the pole is engaged with the latch to hold the latch at the half latch position or the full latch position (rotational movement to the unlatch position is prevented). The unlatch position is a position where the pole is not engaged with the latch, and is a position where the rotational movement of the latch to the unlatch position is allowed. Further, the pole is constantly biased toward the engagement position by a pole return spring.

When the lift lever 36 moves from the initial position to the operating position when the vehicle door 1 is in the closed state, the lift lever 36 is engaged with the pole (for example, pushes the pole) to cause the pole to move from the engagement position to the non-engagement position. Accordingly, the engagement between the pole and the latch is released, the latch rotationally moves to the unlatch position by the biasing force of the latch return spring, and the closed state of the vehicle door 1 can be released. In this way, when the lift lever 36 moves from the initial position to the operating position, the latch mechanism is switched from the latching state to the unlatching state due to the movement of the lift lever 36.

The actuator 40 and the rotation member 39 are examples of drive units disclosed here which cause the release lever 38 to move from an initial position to an operating position. In the present embodiment, a motor which outputs rotational power is applied as the actuator 40, and an output shaft 401 thereof is provided with a worm 402. The actuator 40 is not limited to a specific configuration as long as the actuator 40 can drive the rotation member 39 to rotate in both forward and reverse directions.

The rotation member 39 is rotatably supported on the housing 31 by the fifth support portion 315, and can move to a neutral position, an unlock position, and a release position by rotating. A worm wheel (for example, a helical gear) is applied to the rotation member 39. Further, the helical gear which is the rotation member 39, meshes with the worm 402 of the actuator 40. FIG. 4 illustrates a state in which the rotation member 39 is at the neutral position, FIG. 5 illustrates a state in which the rotation member 39 is at the release position, and FIG. 6 illustrates a state in which the rotation member 39 is at the unlock position.

As illustrated in FIGS. 4 to 6, the neutral position is a position where the release lever 38 is allowed to be located at the initial position, and specifically, is a position where an engaging portion 391 provided on the rotation member 39 does not contact a third engaging portion 383 of the release lever 38 located at the initial position. The release position and the unlock position are positions where the rotation member 39 rotates from the neutral position in opposite directions by a predetermined angle. That is, the neutral position is located between the unlock position and the release position. The rotation member 39 rotationally moves from the initial position to the unlock position and the release position by the driving force of the actuator 40. Further, the rotation member 39 is constantly biased toward the neutral position by a rotation member return spring 54. When the actuator 40 is not operating, the rotation member 39 is held in the neutral position by the rotation member return spring 54.

The rotation member 39 rotationally moves from the neutral position to the release position to cause the release lever 38 to be described later to move from the initial position to the operating position. In the present embodiment, the rotation member 39 includes the protrusion-shaped engaging portion 391 radially separated from a rotation center. The engaging portion 391 is engaged with (presses the third engaging portion 383) the third engaging portion 383 of the release lever 38 by the rotation of the rotating member 39 in a direction from the neutral position to the release position and causes the release lever 38 to move from the initial position to the operating position. The rotation member 39 causes the active lever 37 to move from the first position to the second position by rotationally moving from the neutral position to the unlock position (see FIG. 6). For example, the rotation member 39 includes a protrusion portion (not illustrated). Further, when the rotation member 39 rotationally moves from the neutral position to the unlock position, the protrusion portion contacts the active lever 37 and pushes the active lever 37, thereby causing the active lever 37 to move from the first position to the second position.

The release lever 38 is the example of the second lever member disclosed here. The release lever 38 is rotatably supported on the housing 31 by the fourth support portion 314, and can move to the initial position and the operating position by rotating. FIGS. 4 and 6 illustrate a state in which the release lever 38 is located at the initial position, and FIG. 5 illustrates a state in which the release lever 38 is located at the operating position. The release lever 38 includes the third engaging portion 383 which is releasably engageable with the engaging portion 391 of the rotation member 39, a second engaging portion 382 which is releasably engageable with a second engaging portion 362 of the lift lever 36, and the first engaging portion 381 which is releasably engageable with the third engaging portion 353 of the open link 35.

When the rotation member 39 rotationally moves from the neutral position to the release position, the third engaging portion 383 of the release lever 38 is engaged with and pressed by the engaging portion 391 of the rotation member 39, and the release lever 38 moves from the initial position illustrated in FIG. 4 to the operating position illustrated in FIG. 5. When the release lever 38 moves from the initial position to the operating position, the second engaging portion 382 is engaged with the second engaging portion 362 of the lift lever 36 and presses the second engaging portion 362 to cause the lift lever 36 to move from the initial position to the operating position. Further, as described above, when the lift lever 36 moves from the initial position to the operating position when the vehicle door 1 is in the closed state, the latch mechanism is switched from the latching state to the unlatching state, and the vehicle door 1 is in the state in which the closed state can be released.

When the release lever 38 moves from the initial position to the operating position when the open link 35 is located at the lock position, the first engaging portion 381 of the release lever 38 is engaged with the third engaging portion 353 of the open link 35 and presses the third engaging portion 353 to cause the open link 35 to move to the unlock position. Further, when the release lever 38 is moving from the initial position to the operating position, the first engaging portion 381 of the release lever 38 is engaged with the third engaging portion 353 of the open link 35, so that the biasing force (biasing force to bias the open link 35 toward the lock position) of the biasing member 50 is transmitted to the release lever 38 via the open link 35. Therefore, the release lever 38 is biased toward the initial position.

The first engaging portion 381 of the release lever 38 is located in a direction where the open link 35 faces the lock position when viewed from the third engaging portion 353 of the open link 35. When the release lever 38 is located at the initial position, the open link 35 can move to the lock position and the unlock position without interfering with the release lever 38. When the release lever 38 moves from the initial position to the operating position by the rotation of the rotation member 39, the first engaging portion 381 of the release lever 38 is engaged with the third engaging portion 353 of the open link 35 and presses the third engaging portion 353 to cause the open link 35 to move from the lock position to the unlock position. On the other hand, when the open link 35 is biased toward the lock position by the biasing member 50, the third engaging portion 353 of the open link 35 is engaged with and pressed by the first engaging portion 381 of the release lever 38. Therefore, the release lever 38 is biased toward the initial position.

Here, the operation of the door lock device 3 when the outside door handle 16 and the inside door handle 17 are operated to open the door will be described.

When the inside door handle 17 is operated to open the door, the door lock device 3 changes from the state illustrated in FIGS. 7 and 8 to the state illustrated in FIGS. 9 and 10. That is, the operation of the inside door handle 17 is transmitted to the outside open lever 34 via the inside open lever 32 and the inside lever 33, and the outside open lever 34 moves from the initial position to the operating position. Further, when the outside door handle 16 is operated to open the door, the operation of the outside door handle 16 is transmitted to the outside open lever 34. Therefore, the outside open lever 34 moves from the initial position to the operating position as illustrated in FIG. 9 with the inside open lever 32 and the inside lever 33 held at the initial positions (see FIG. 7). Then, the open link 35 moves from the initial position to the operating position together with the outside open lever 34.

In a state (unlocked state) in which the open link 35 is located at the unlock position, when the open link 35 moves from the initial position to the operating position together with the outside open lever 34, the first engaging portion 351 of the open link 35 is engaged with the first engaging portion 361 of the lift lever 36, and causes the lift lever 36 to move from the initial position to the operating position. Then, the pole of the latch mechanism moves from the engagement position to the non-engagement position by the movement of the lift lever 36, and the latch moves to the unlatch position by the latch return spring. Accordingly, the latch is switched from the latching state to the unlatching state, and the vehicle door 1 is in the state in which the closed state can be released.

On the other hand, in a state (locked state) in which the open link 35 is located at the lock position, even when the open link 35 moves from the initial position to the operating position, the first engaging portion 351 of the open link 35 is not engaged with the first engaging portion 361 of the lift lever 36, and therefore the lift lever 36 is held at the initial position. Therefore, since the latch mechanism is held in the latching state, the vehicle door 1 cannot be released from the closed state.

In this way, when the open link 35 is located at the lock position, even when the inside door handle 17 and the outside door handle 16 are operated to open the door, the vehicle door 1 is held in a state (state in which the vehicle door 1 cannot be released from the closed state) in which the vehicle door 1 can be held at the closed state. That is, the door lock device 3 is in the unlocked state when the open link 35 is in the unlock position, and is in the locked state when the open link 35 is in the lock position.

Next, the operation of the door lock device 3 by the driving force of the actuator 40 will be described.

In a state (see FIG. 4) in which the active lever 37 is located at the first position and the open link 35 is located at the lock position, when the actuator 40 operates and the rotation member 39 rotationally moves from the neutral position to the release position, as illustrated in FIG. 5, the engaging portion 391 of the rotation member 39 is engaged with the third engaging portion 383 of the release lever 38 and causes the release lever 38 to move from the initial position to the operating position. When the release lever 38 moves to the operating position, the second engaging portion 382 of the release lever 38 is engaged with the second engaging portion 362 of the lift lever 36 and causes the lift lever 36 to move from the initial position to the operating position. Further, the first engaging portion 381 of the release lever 38 is engaged with the third engaging portion 353 of the open link 35 and causes the open link 35 to move from the lock position to the unlock position against the biasing force of the biasing member 50. At this time, the second engaging portion 352 of the open link 35 pushes one of the two arms 501 of the biasing member 50, and the biasing member 50 elastically deforms so that the interval between the two arms 501 increases.

When the lift lever 36 is pressed by the release lever 38 to move to the operating position, the latch mechanism is in the unlatching state, and the vehicle door 1 is in a state in which the closed state can be released, as in the case of the inside door handle 17 and the outside door handle 16 being operated to open the door. The release lever 38 is directly engaged with the lift lever 36 without the open link 35 and causes the lift lever 36 to move to the operating position. Therefore, when the driving force of the actuator 40 is used, the latch mechanism can be switched to the unlatching state even when the door lock device 3 is in the locked state. Further, as described above, when the vehicle door 1 can be opened by the driving force of the actuator 40 in a state in which the door lock device 3 is in the locked state, the open link 35 moves from the lock position to the unlock position against the biasing force of the biasing member 50. At this time, the open link 35 is biased toward the lock position.

When the actuator 40 stops, the rotation member 39 returns to the neutral position by the biasing force of the rotation member return spring 54. Then, the release lever 38 can move to the initial position. Further, the open link 35 moves to the lock position by the biasing force of the biasing member 50, and presses the release lever 38 by the biasing force of the biasing member 50 to cause the release lever 38 to move to the initial position. Accordingly, the door lock device 3 returns to the state illustrated in FIG. 4.

In the state (see FIG. 4) in which the active lever 37 is located at the first position and the open link 35 is located at the lock position, when the actuator 40 operates and the rotation member 39 rotationally moves from the neutral position to the unlock position, the rotation member 39 causes the active lever 37 to move from the first position illustrated in FIG. 4 to the second position illustrated in FIG. 6. When the active lever 37 moves from the first position to the second position, the open link 35 is biased to the unlock position by the biasing member 50, and is located at the unlock position. In this way, the door lock device 3 is switched from the locked state to the unlocked state by the driving force of the actuator 40. The active lever 37 and the rotation member 39 may be linked so that the active lever 37 moves from the lock position to the unlock position by the rotation member 39 rotating from the neutral position to the unlock position, and a specific configuration of linkage is not limited.

As described above, when the release lever 38 moves from the initial position to the operating position by the driving force of the actuator 40 in the state in which the active lever 37 is located at the first position, the release lever 38 causes the lift lever 36 to move to the operating position, and the release lever 38 causes the open link 35 to move to the unlock position against the biasing force of the biasing member 50. Further, when the operation of the actuator 40 stops after the release lever 38 moves to the operating position, the open link 35 moves from the unlock position to the lock position by the biasing force of the biasing member 50, and the open link 35 causes the release lever 38 to move to the initial position. In this way, in the door lock device 3, two members, the open link 35 which is a member switchable to the locked state and the unlocked state, and the release lever 38 which is a member that switches the latching state and the unlatching state of the latch mechanism, are biased by one biasing member 50.

According to such a configuration, a biasing member for returning the release lever 38 to the initial position may not be separately disposed. Therefore, the number of components can be reduced, and a size of the door lock device 3, for example, a thickness thereof can be reduced. For example, in a configuration in which a torsion coil spring for biasing the release lever 38 to the initial position is mounted on a support shaft of the release lever 38, a dimension of the release lever 38 in a rotation center line direction of the door lock device 3 increases. In the present embodiment, since such a biasing member need not be mounted on the support shaft of the release lever 38, the dimension of the door lock device 3 in a support axis direction can be reduced. That is, the thickness of the door lock device 3 can be reduced. Even when a biasing member other than the torsion coil spring is used, a space for disposing the biasing member about the release lever 38 is necessary. Therefore, the size of the door lock device 3 increases. In contrast, according to the present embodiment, since a biasing member other than the biasing member 50 may not be disposed about the release lever 38, the size of the door lock device 3 can be reduced.

Although the embodiment disclosed here is described above, this disclosure is not limited to the above embodiment.

For example, the described-above embodiment describes an example in which the torsion coil spring including two arms 501 is applied as the biasing member 50. However, the biasing member 50 is not limited to such a torsion coil spring. The biasing member 50 may bias the open link 35 toward the lock position when the active lever 37 is located at the first position, bias the open link 35 toward the unlock position when the active lever 37 is located at the second position, and may be elastically deformed when the active lever 37 is located at the first position so that the open link 35 can move to the unlock position.

The latch mechanism can be switched to the latching state in which the vehicle door is held at the closed state and the unlatching state in which the closed state of the vehicle door is released. The latch mechanism may be switched from the latching state to the unlatching state by the lift lever 36 moving from the initial position to the operating position.

Further, the described-above embodiment describes the configuration in which the open link 35 which is releasably engageable with the lift lever 36 is rotatably supported with respect to the outside open lever 34. However, the open link 35 may be rotatably supported with respect to the inside open lever 32. In this case, the inside open lever 32 moves to the operating position by the inside door handle 17 being operated to open the door, and may move from the initial position to the operating position according to the movement of the outside open lever 34.

In order to solve the above problems, a vehicle door lock device according to this disclosure includes: a latch mechanism switching member (36) configured to switch a latch mechanism to an unlatching state by moving from an initial position to an operating position, the latch mechanism being switchable to a latching state in which a vehicle door (1) is held in a closed state and an unlatching state in which the closed state of the vehicle door (1) is released; a first lever member (34) configured to move to an operating position when a door handle (16 and 17) provided on the vehicle door (1) is operated to open the door; a link member (35) which is movable to an unlock position where the link member is engaged with the latch mechanism switching member (36) and the latch mechanism is switched to the unlatching state when the first lever member (34) moves to the operating position, and a lock position where the link member is not engaged with the latch mechanism switching member (36) and the latch mechanism is not switched to the unlatching state; a second lever member (38) which is releasably engageable with the link member (35) and is configured to cause the latch mechanism switching member (36) to move to the operating position by moving from an initial position to an operating position; a biasing member (50) configured to bias the link member toward the lock position; and a drive unit (39 and 40) configured to drive the second lever member (38) to move from the initial position to the operating position. When the second lever member (38) is driven by the drive unit (39 and 40) to move to the operating position, the second lever member (38) causes the latch mechanism switching member (36) to move to the operating position, and causes the link member (35) to move to the unlock position against a biasing force of the biasing member (50). When the drive unit (39 and 40) stops after moving the second lever member (38) to the operating position, the link member (35) moves to the lock position by the biasing force of the biasing member (50) and causes the second lever member (38) to move to the initial position.

When this disclosure is configured in this way, two members, the link member (35) which is a member switchable to the locked state and the unlocked state, and the second lever member (38) which is a member that switches the latching state and the unlatching state of the latch mechanism, are biased by one biasing member (50). Accordingly, a biasing member for returning the second lever member (38) to the initial position may not be separately disposed. Therefore, the number of components of the door lock device (3) can be reduced, and a size of the door lock device (3) can be reduced.

The second lever member (38) may include a first engaging portion (381) configured to be engaged with the link member (35) and cause the link member (35) to move to the unlock position against the biasing force of the biasing member (50) when the second lever member (38) is driven by the drive unit (39 and 40) to move to the operating position, and a second engaging portion (382) configured to be engaged with the latch mechanism switching member (36) and cause the latch mechanism switching member (36) to move to the operating position.

When this disclosure is configured in this way, the second lever member (38) presses the latch mechanism switching member (36) via the second engaging portion (382) and causes the latch mechanism switching member (36) to move to the operating position, and the biasing force of the biasing member (50) is transmitted to the second lever member (38) via the first engaging portion (381). Therefore, after causing the latch mechanism switching member (36) to move to the operating position, the second lever member (38) returns to the initial position by the biasing force of the biasing member (50) transmitted via the first engaging portion (381).

The vehicle door lock device may further include a third lever member (37) which is movable to a first position and a second position. The biasing member (50) biases the link member (35) toward the lock position when the third lever member (37) is located at the first position, and biases the link member (35) toward the unlock position when the third lever member (37) is located at the second position.

The biasing member (50) may be a torsion coil spring which includes two arms (501) and is elastically deformable so that an interval between the two arms increases. The link member (35) may include a protrusion-shaped engaging portion (352). The engaging portion (352) may be disposed between the two arms (501).

When this disclosure is configured in this way, when the lift lever (36) is located at the initial position, the biasing member (50) can bias the link member (35) toward the lock position when the third lever member (37) is located at the first position, and can bias the link member (35) toward the unlock position when the third lever member (37) is located at the second position. Further, since the biasing member (50) is elastically deformed so that the interval between the two arms increases, the link member (35) is allowed to move to the unlock position even when the third lever member (37) is located at the first position.

The drive unit (39 and 40) may include a rotation member (39) rotatable to an unlock position, a release position, and a neutral position between the unlock position and the release position. The rotation member (39) may cause the second lever member (38) to move from the initial position to the operating position when rotating from the neutral position to the release position, and cause the link member (35) to move from the lock position to the unlock position when rotating from the neutral position to the unlock position.

When this disclosure is configured in this way, even when the vehicle door lock device (3) is in the locked state, the drive unit (39 and 40) can drive the latch mechanism into the unlatching state, and the vehicle door lock device (3) can be switched from the locked state to the unlocked state by the drive unit (39 and 40).

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock device comprising:

a latch mechanism switching member configured to switch a latch mechanism to an unlatching state by moving from an initial position to an operating position, the latch mechanism being switchable to a latching state in which a vehicle door is held in a closed state and the unlatching state in which the closed state of the vehicle door is released;

a first lever member configured to move to an operating position when a door handle provided on the vehicle door is operated to open the door;

a link member which is movable to an unlock position where the link member is engaged with the latch mechanism switching member and the latch mechanism is switched to the unlatching state when the first lever member moves to the operating position, and a lock position where the latch mechanism is not switched to the unlatching state because the link member is not engaged with the latch mechanism switching member;

a second lever member which is releasably engageable with the link member and is configured to cause the latch mechanism switching member to move to the operating position by moving from an initial position to an operating position;

a biasing member configured to bias the link member toward the lock position; and a drive unit configured to cause the second lever member to move from the initial position to the operating position, wherein when the second lever member is driven by the drive unit to move to the operating position, the second lever member causes the latch mechanism switching member to move to the operating position, and causes the link member to move to the unlock position against a biasing force of the biasing member, when the drive unit stops after moving the second lever member to the operating position, the link member moves to the lock position only by the biasing force of the biasing member and causes the second lever member to move to the initial position, and the link member includes a first engaging portion that is releasably engageable with the latch mechanism switching member and a second engaging portion that is engaged with the biasing member, the first engaging portion and the second engaging portion configured to rotate together around a common axis.

2. The vehicle door lock device according to claim 1, wherein the second lever member includes a third engaging portion configured to be engaged with the link member and cause the link member to move to the unlock position against the biasing force of the biasing member when the second lever member is driven by the drive unit to move to the operating position, and a fourth engaging portion configured to be engaged with the latch mechanism switching member and cause the latch mechanism switching member to move to the operating position.

3. The vehicle door lock device according to claim 1, further comprising:

a third lever member which is movable to a first position and a second position, wherein the biasing member biases the link member toward the lock position when the third lever member is located at the first position, and biases the link member toward the unlock position when the third lever member is located at the second position.

4. The vehicle door lock device according to claim 1, wherein the biasing member is a torsion coil spring which includes two arms and is elastically deformable so that an interval between the two arms increases, the second engaging portion is a protrusion-shaped engaging portion, and the second engaging portion is disposed between the two arms.

5. The vehicle door lock device according to claim 1, wherein the drive unit includes a rotation member rotatable to an unlock position, a release position, and a neutral position between the unlock position and the release position, and the rotation member causes the second lever member to move from the initial position to the operating position when rotating from the neutral position to the release position, and causes the link member to move from the lock position to the unlock position when rotating from the neutral position to the unlock position.

6. The vehicle door lock device according to claim 1, wherein when the drive unit stops after moving the second lever member to the operating position, the link member moves to the lock position only by the biasing force of the biasing member and causes the second lever member to move to the initial position.

* * * * *